United States Patent [19]

Peruski

[11] Patent Number: 4,933,019

[45] Date of Patent: Jun. 12, 1990

[54] COLLAPSIBLE SHELTER

[76] Inventor: Robert H. Peruski, 1260 Morrison, Ubly, Mich. 48475

[21] Appl. No.: 318,978

[22] Filed: Mar. 6, 1989

[51] Int. Cl.[5] ..... E04H 15/00

[52] U.S. Cl. ..... 135/106; 135/101; 135/DIG. 9

[58] Field of Search ..... 135/98, 106, 100, 101, 135/102, DIG. 9, 900, 901

[56] References Cited

U.S. PATENT DOCUMENTS

| | | | |
|---|---|---|---|
| 557,605 | 4/1896 | Reid | 135/98 |
| 706,605 | 8/1902 | Slyder | 135/98 |
| 2,953,145 | 9/1960 | Moss et al. | 135/98 |
| 3,186,420 | 6/1965 | Magee | 135/106 |

FOREIGN PATENT DOCUMENTS

| | | | |
|---|---|---|---|
| 1107904 | 5/1961 | Fed. Rep. of Germany | 135/98 |
| 2614058 | 10/1988 | France | 135/106 |
| 599441 | 11/1959 | Italy | 135/98 |
| 8602480 | 6/1987 | Netherlands | 135/106 |
| 35399 | 1/1906 | Switzerland | 135/106 |

*Primary Examiner*—Carl D. Friedman
*Assistant Examiner*—Caroline D. Dennison
*Attorney, Agent, or Firm*—John J. Swartz

[57] ABSTRACT

A collapsible frame for a portable shelter including a plurality of cover supporting frame bars pivotally mounted at one end on a central hub. The hub includes a pair of vertically spaced apart plates. The frame bars include inverted L-shaped support bars including a generally vertical, ground supported leg and an integral generally horizontal base received between the plates. The terminal end of the horizontal base is pivotally mounted in an aperture provided in one of the plates. One of the plates also includes a plurality of recesses which receive the horizontal base in one position of rotation about its terminal end. A spring mechanism is provided for urging the plates together to hold the horizontal members in the recesses but allowing spreading movement thereof such that the frame bars can rotate between stowed, generally side-by-side positions, and angularly disposed positions received in the recesses.

18 Claims, 3 Drawing Sheets

COLLAPSIBLE SHELTER

BACKGROUND OF THE INVENTION

1. Field of the Invention

This invention relates to a portable personnel shelter and more particularly to a new and novel lightweight frame for a collapsible shelter which can be easily erected and collapsed.

2. Description of the Prior Art

Hunters and photographers frequently utilize blinds to conceal themselves from the game they are pursuing. In wooded areas which have natural blind material, hunters sometimes still prefer additional shelter to conceal their movement and protect themselves from the elements. Although hunters frequently utilize natural habitat with which to construct a blind, it sometimes occur that a hunter will be without natural cover. In such case, the hunter may erect a blind for concealing himself. If th hunter does not own the hunting land, the hunter will want to use a blind which can be easily transportd to and from the hunting site. Accordingly, it is an object of the present invention to provide a new and novel portable hunting blind.

Ice fishermen also utilize a shelter to protect themselves from the elements as they fish through the ice. Such a shelter should be portable, lightweight and easily erected and dismantled at the fishing site. Accordingly, it is another object of the present invention to provide a new and novel portable shelter which can be utilized to protect a sportsperson from the elements and to conceal his movements.

Young children must also be protected from excessive sun exposure at the beach. It has been found that a portable collapsible shelter constructed according to the present invention is particularly adapted for providing a shelter from the sun.

It is important that the blind and/or shelter be constructed in such a way that it can be easily and quickly erected and collapsed. Because hunting sites are frequently accessible only by foot, it is important that the shelter be portable, lightweight and easy to carry. It is also important that the device be structurally sound to inhibit movement by wind and the like. Accordingly, it is an object of the present invention to provide a new and novel portable shelter frame which will tend to remain stationary after assembly.

It is another object of the present invention to provide a collapsible frame for a portable shelter of the type described including a mounting hub having vertically spaced apart mounting plates which sandwich a pivotally mounted portion of a plurality of angularly disposed, cover supporting legs that can be moved from a collapsed, side-by-side condition, to an extended angularly spaced condition.

A still further object of the present invention is to provide a collapsible frame for a portable shelter of the type described including a mounting hub having a pair of spaced apart plates including recesses which rceive a base portion of each of a plurality of cover support legs to allow the legs to move between an assembled, angularly spaced apart condition and a collapsed side-by-side condition.

Various attempts have been made heretofore to construct blinds and portable shelter such as those disclosed in the following United States patents:

| U.S. Pat. No.: | Patentee | Issue Date |
|---|---|---|
| 2,623,532 | McGanty | Dec. 30, 1952 |
| 3,690,334 | Miller | Sep. 12, 1972 |
| 3,902,264 | Radig | Sep. 2, 1975 |
| 4,355,650 | Beaudry | Oct. 26, 1982 |
| 4,425,929 | Von Mosshaim | Jan. 17, 1984 |
| 4,478,234 | Bester | Oct. 23, 1984 |

Other objects and advantages of the present invention will become apparent to those of ordinary skill in the art as the description thereof proceeds.

SUMMARY OF THE INVENTION

A collapsible frame for a portable shelter comprising: a hub; and a plurality of cover support frame bars swingably mounted on the hub; the hub including a pair of vertically spaced apart mounting plates; each of the bars including a generally horizontal base integrally coupled to a vertically depending leg; mechanism for yieldably urging the plates together but allowing spreading movement thereof to spread positions; a portion of the horizontal base being received between the plates and including a terminal end, pivotally mounting the frame bars on one of the plates for swinging movement between collapsed, stowed positions and spread operative positions in which the vertically depending legs are angularly spread apart about the hub.

BRIEF DESCRIPTION OF THE DRAWINGS

The invention may be more readily understood by referring to the accompanying drawings, in which.

DESCRIPTION OF THE PREFERRED EMBODIMENT

Figure 1:
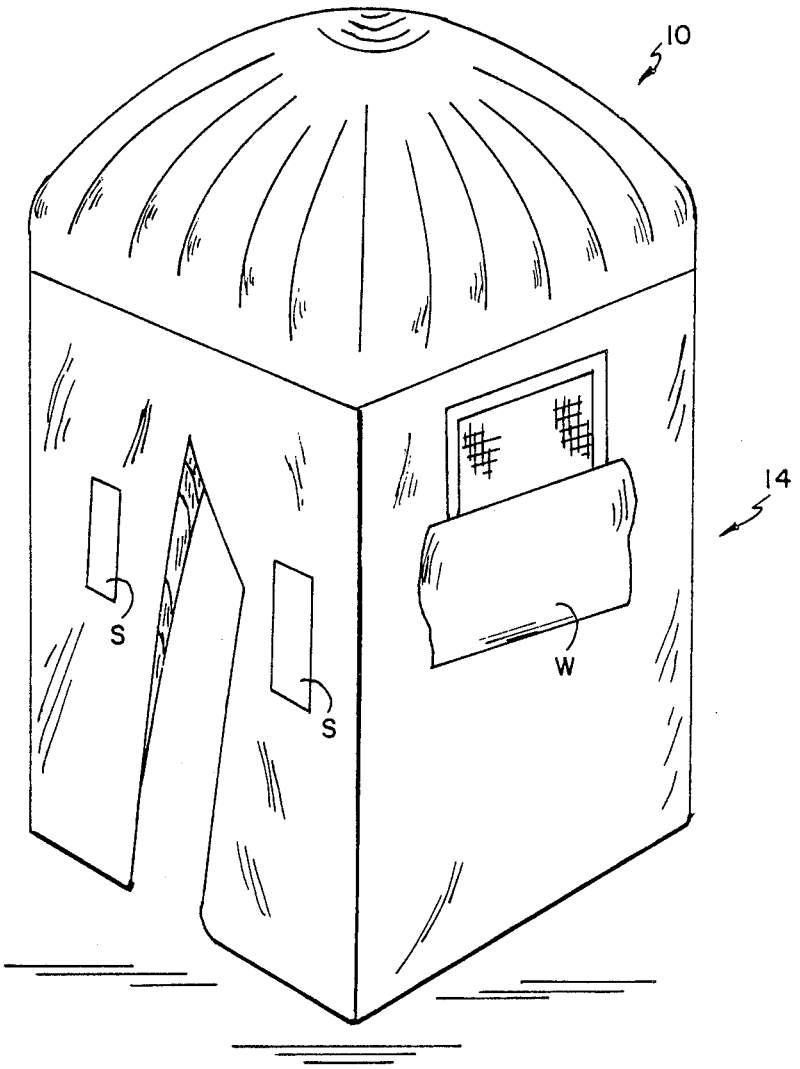
FIG. 1 is a perspective view of a collapsible portable shelter constructed according to the present invention.
Figure 5:
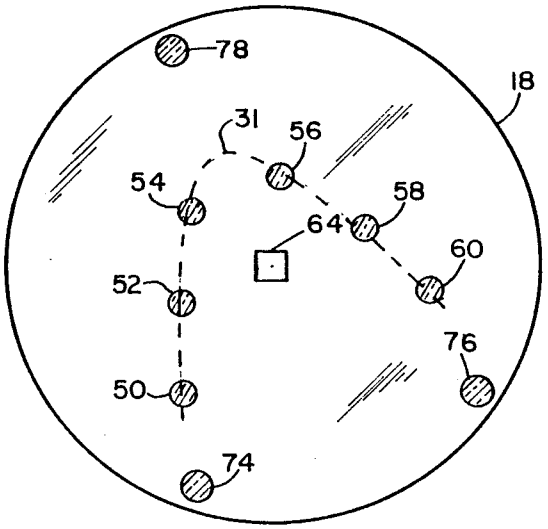
FIG. 5 is a sectional, bottom plan view, taken along the line 5—5 of FIG. 2, ilustrating the upper plate of two vertically spaced, mounting hub plates.

A portable shelter constructed according to the present invention, generally designated 10, includes a collapsible frame, generally designated 12, mounting a cover or shroud, generally designated 14. If desired, the shroud 14 can include a floor (not shown) which underlies the frame 12.

The collapsible frame 12 includes a mounting hub, generally designated 13, mounting a plurality of angularly disposed cover support frame bars, generally designated 16.

The hub 13 includes upper and lower vertically spaced apart circular mounting plates 18 and 19, respectively.

Figure 4:
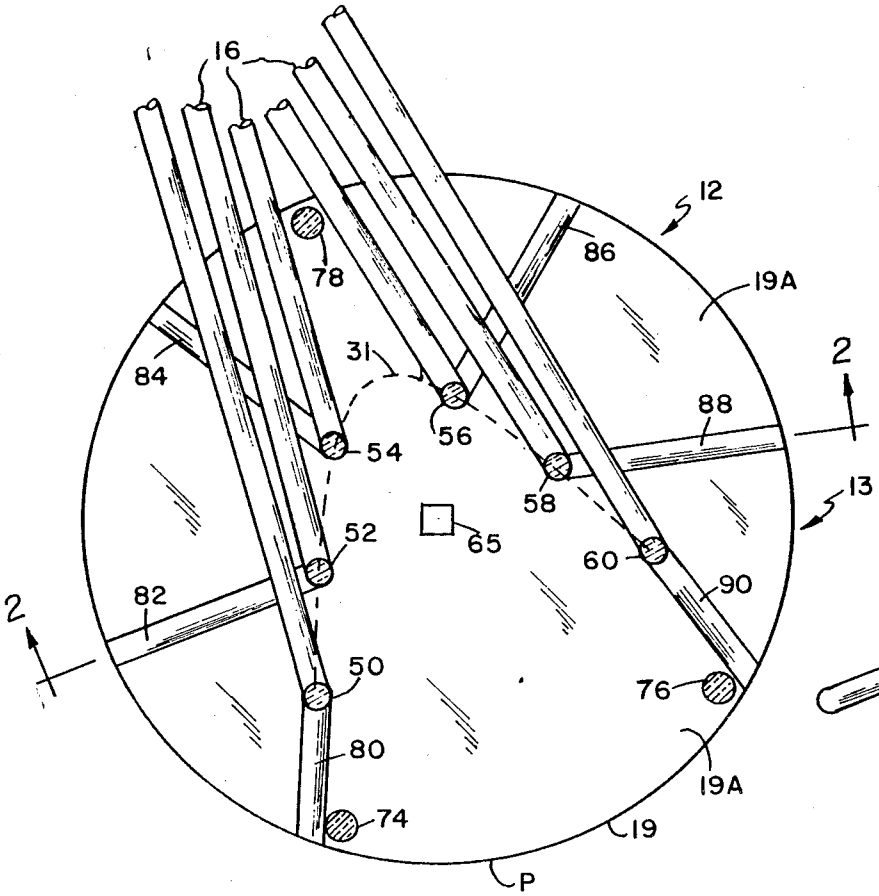
FIG. 4 is an enlarged top plan view similar to FIG. 3, illustrating the bottom hub plate and the cover support frame bars in the stowed or closed positions.

The frame bars, generally designated 16, include generally inverted L-shaped support legs, generally designated 20, 22, 24, 26, 28 and 30. The frame bars 16 are generally identical and each include an upstanding ground supported leg 42 and a horizontal, integral horizontal base 44. The radially inner portion 46 of each horizontal frame bar base 44 is received between the hub plates 18 and 19. The legs 20, 22, 24, 26, 28 and 30 each include a T-shaped terminal end 48 which is pivotally received in vertically aligned openings 50, 52, 54, 56, 58 and 60, respectively, provided in each of the lower and upper hub plates 18 and 19. The holes 50–60 are asymetrically located about a central axis A as illustrated by the dotted line 31 (FIG. 4).

Figure 2:
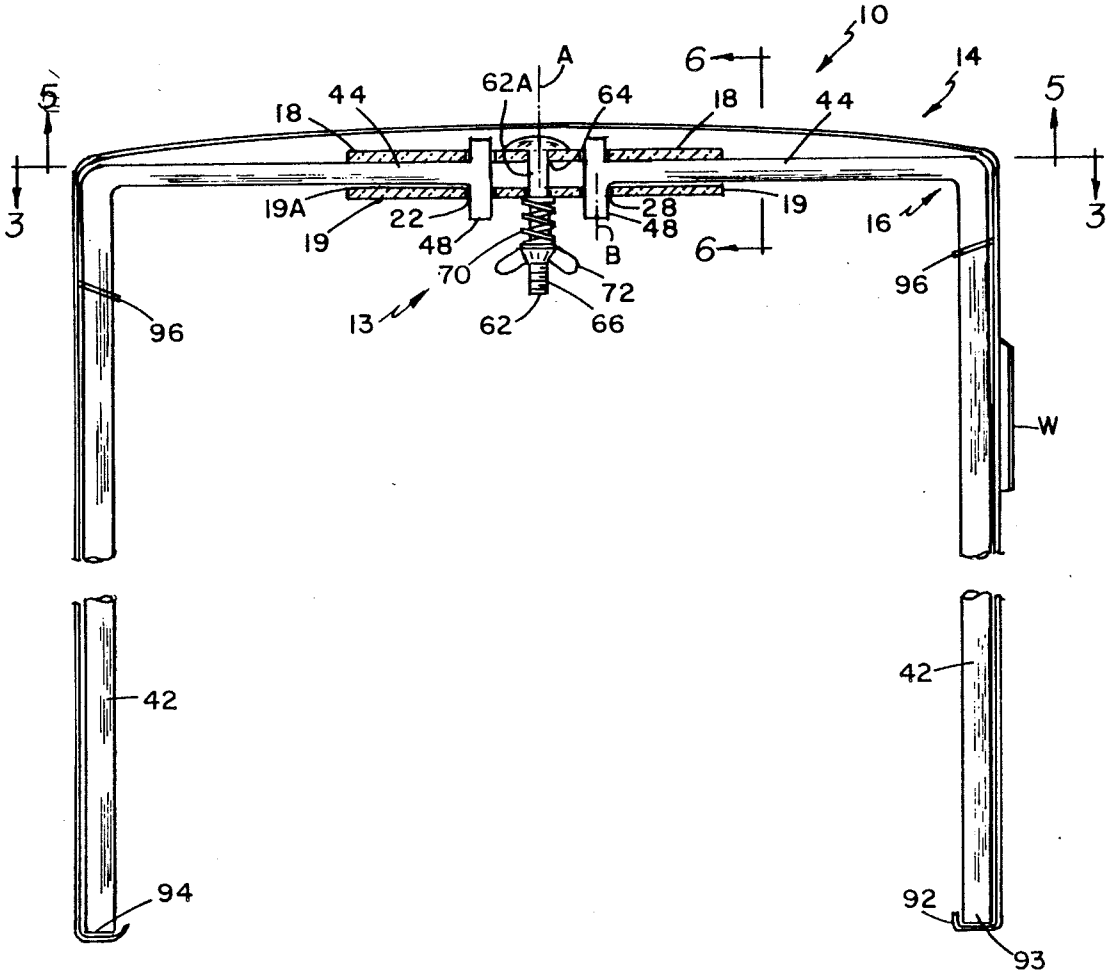
FIG. 2 is an enlarged vertical sectional view of the shelter, taken along the line 2—2 of FIG. 4.

Mechanism is provided for yieldably urging the hub plates 18 and 19 to the frame bar clamping positions illustrated in FIG. 2 and includes a central bolt 62 having a squared upper shank portion 62A slidably received in squared apertures 64 and 65 respectively, provided in the hub plates 18 and 19. A coil spring 70 is mounted on a threaded shank portion 66 of bolt 62, between a nut 72, which is threaded on the bolt shank 66, and the underside of the lower plate 19. The frame bars 16 are movable about the vertical axes B of offset ends 48 between the spread positions illustrated in FIG. 3 and the stowed, generally side-by-side positions, illustrated in FIG. 4.

Three equi-angularly spaced stops 74, 76 and 78 are provided on underside of the upper plate 18. The stops 74 and 76 interrupt the swinging movement of the L-shaped frame legs 20, 30 when the legs 20, 30 respectively reach the spread positions illustrated in FIG. 3. The other stop 78 functions as a central brace for the frame bars 16 in the stowed positions illustrated in FIG. 4.

The upper surface 19A of the lower hub plate 19 includes a plurality of troughs or locating recesses 80, 82, 84 86, 88 and 90 which extend outwardly from the apertures 50, 52, 54, 56, 58 and 60, respectively, to the outer circumferential portion or periphery P of plate 19. The troughs or recesses 80, 82, 84, 86, 88 and 90 receive the horizontal leg portions 46 of the frame bars 20, 22, 24, 26, 28 and 30 respectively, when the frame legs 16 are in the spread positions illustrated in FIG. 3. When the leg portions 46 are received in the recesses or troughs 80–90 provided in the upper surface **19*a* of the plate 19, the L-shaped bars 16 will tend to resist swinging movement and thus will rigidify the structure when assembled. The bars 16 can be made of fiberglass and the plates 18 and 19** can suitably be made of plastic.

Figure 6:
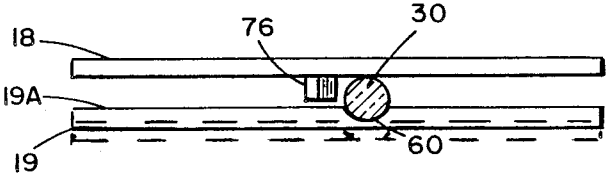
FIG. 6 is a fragmentary sectional view, taken along the line 6—6 of FIG. 4, more particularly illustrating one of the frame support bars in its operative spread position sandwiched between a pair of hub plates.

The coil spring 70 exerts sufficient biasing force so the hub plates 18 and 19 to restrict movement of frame bars 16 out of the troughs 80–90. The force exertd by spring 70 restricts the free swinging movement of the frame bars 16 from the spread positions yet allows spreading movement of the plates 18 and 19, to the vertically spaced positions illustrated in chain lines in FIG. 6 so that the frame bars 16 can move from the spread positions illustrated in FIG. 3, to the stowed positions illustrated in FIG. 4.

The spring 70 yieldably urges the plates 18 and 19 together to positions spaced apart a distance less than the vertical thickness of the horizontal leg portions 44. By adjusting the position of nut 72 on threaded shank 66, the bearing force exerted by spring 70 can be adjusted.

The covering 14 is draped over the frame bars 16 and includes, at the lower terminal end, a portion 92 folded over on itself to provide an annular, upwardly opening U-shaped end portion 94 receiving the lower terminal ends 93 of vertical legs 42. The cover C can suitably be manufactured from any suitable substance, such as canvas cloth, or screen mesh, which is easily collapsed and folded when the support bars 16 move from the extended positions to the stowed positions.

A plurality of ties 96 couple the canvas to the legs 16. The ties 96 may be suitably include "velcro" fastener straps. The covering 14 of such size as to be substantially taut when the legs 16 are in the expanded positions illustrated in solid lines in FIG. 2 and 3. If desired, suitable window openings, generally designated W, covered by screens or the like, may be provided in the covering 14.

Shooting openings, generally designated S, may be provided in the canvas cover 14 as needed.

THE OPERATION

When not in use, the frame suppoirt bars 16 are in the stowed positions as illustrated in solid lines in FIG. 4.

Figure 3:
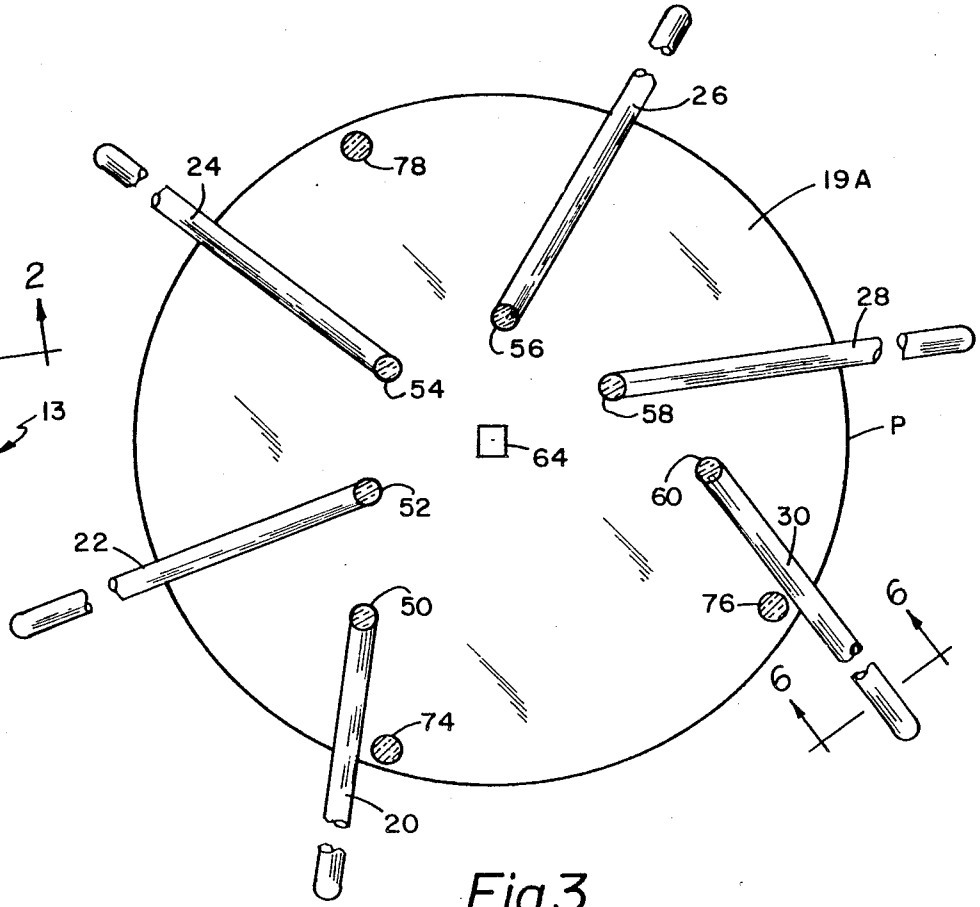
FIG. 3 is an enlarged top plan view, taken along the line 3—3 of FIG. 2, illustrating the bottom hub plate and the cover support frame bars in their spread, operative positions.

The sportsman can carry the blind to the desired location where he will swing the frame bars 16 about their pivotal offset ends 48 in the hub apertures 50–60 to the positions illustrated in FIG. 3. In these operative positions, the horizontal base portions 44 of legs 20, 22, 24, 26, 28 and 36 will be received in the locating recesses 80, 82, 84, 86, 88 and 90 respectively.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A collapsible frame for a portable shelter comprising:

a hub;

a plurality of cover support frame bars swingably mounted on said hub;

said hub including a pair of vertically spaced apart plates mounted for relative vertical movement between rest positions and spread positions;

each of said bars including a generally horizontal base portion having a predetermined vertical thickness and an integral, vertically depending leg portion;

said horizontal base portions being received between said plates;

means for yieldably urging said plates together to said rest positions spaced apart a distance less than said vertical thickness of said horizontal base portions but allowing spreading movement thereof to said spread positions equal to said thickness of said horizontal base portions;

said base portions including terminal ends pivotally mounting said frame bars on one of said plates for swinging movement between collapsed stowed positions in which said vertically depending leg portions are laterally side-by-side and spread, operative positions in which said vertically depending leg portions are angularly spread about said hub.

2. The frame set forth in claim 1 wherein said plates are independent of each other and include vertically outer surfaces and vertically inner, confronting surfaces, a plurality of angularly disposed locating recesses in one of said confronting surfaces for receiving said horizontal base portions in said spread positions.

3. The frame set forth in claim 2 wherein one of said plates includes a plurality of mounting recesses pivotally mounting said terminal ends; saids locating recesses being aligned with said mounting recesses.

4. The frame set forth in claims 3 wherein said locating recesses extend between said mounting recesses and the periphery of said one plate.

5. The collapsible frame set forth in claim 1 wherein said means for yieldably urging said plates together include spring means urging said plates together.

6. The collapsible frame set forth in claim 5 wherein one of said plates includes a plurality of recesses receiving said terminal ends.

7. The collapsible frame set forth in claim 6 wherein said recesses are asymetrically disposed.

8. The collapsible frame set forth in claim 7 including stop means disposed between said plates for limiting the swinging movement of at least one of said frame bars.

9. The collapsible frame set forth in claim 7 including means for detachably coupling a cover to said leg portions.

10. A collapsible frame for a portable shelter comprising:

a hub;

a plurality of frame bars, adapted to mount a cover, swingably mounted on said hub including a pair of spaced apart mounting plate means;

said frame bars each including an upstanding leg portion and an integral transverse base portion having a terminal end pivotally mounted between said plate means for swinging movement between stowed positions in which said leg portions are side-by-side and spread positions;

said plate means including a plurality of angularly disposed locating recesses for receiving portions of said base portions when said frame bars are in said spread positions; and means for releasably urging said frame bars in a direction toward said plate means to be received by said recesses but permitting said frame bars to move out of said recesses to allow said frame bars to pivot on said hub.

11. The frame set forth in claim 10 wherein said plate means includes a plurality of mounting recesses pivotally receiving the terminal ends of said base portions; said locating recesses extending between said locating recesses and the periphery of said plate means.

12. The frame set forth in claim 11 wherein said means for releasably urging said frame bars into said recesses includes an additional plate and spring means urging said plate toward said plate means.

13. The frame set forth in claim 10 wherein said plate means includes a pair of vertically spaced apart plates, said means for releasably urging said frame bars includes a central pin coupled to one of said plates; the other of said plates including a central aperture slidably receiving said pin; said spring means including a spring reacting between a portion of said pin and the said other plate to urge said other plate toward said one plate.

14. The frame set forth in claim 13 wherein said mounting recesses are eccentrically disposed relative to said pin.

15. The frame set forth in claim 10 wherein said hub comprises a pair of vertically spaced apart plates which receive a portion of said transverse base therebetween.

16. The frame set forth in claim 15 wherein at least one of said plates includes a plurality of apertures therein pivotally receiving said terminal ends; and said means for releasably urging said frame bars being disposes between said apertures.

17. The frame set forth in claim 16 wherein said means for releasably urging said frame bars includes spring means for urging said plates together.

18. The frame set forth in claim 17 including means for adjusting the amount of force exerted by said spring means on said plates.

* * * * *